United States Patent [19]

LeBlond

[11] 4,275,820

[45] Jun. 30, 1981

[54] PERSONAL REPELLENT DEVICE

[75] Inventor: J. Paul LeBlond, Burnaby, Canada

[73] Assignee: J. W. Small, Austin, Tex.

[21] Appl. No.: 105,742

[22] Filed: Dec. 19, 1979

Related U.S. Application Data

[63] Continuation of Ser. No. 875,190, Feb. 3, 1978, abandoned.

[30] Foreign Application Priority Data

Dec. 16, 1977 [CA] Canada ..... 293259

[51] Int. Cl.[3] ..... B65D 47/10

[52] U.S. Cl. ..... 222/3; 128/203.21; 222/175; 222/541

[58] Field of Search ..... 222/3, 5, 175, 541; 109/29, 32, 34; 128/200, 272, 203.21; 401/132; 206/438, 439, 484.1; 424/40

[56] References Cited

U.S. PATENT DOCUMENTS

| | | | |
|---|---|---|---|
| 1,643,954 | 10/1927 | Prentice | 424/40 |
| 2,395,109 | 2/1946 | Fonda | 128/200 |
| 3,106,511 | 10/1963 | Cuttler et al. | 424/45 |
| 3,450,313 | 6/1969 | Jonas | 222/175 X |
| 3,856,142 | 12/1974 | Vessalo | 128/272 X |
| 3,881,634 | 5/1975 | Thrun | 222/3 |

*Primary Examiner*—F. J. Bartuska

*Attorney, Agent, or Firm*—Wenderoth, Lind & Ponack

[57] ABSTRACT

A personal repellent device comprises a capsule having a perforated outer shell composed of a deformable material and a rupturable sealed inner container disposed within the outer shell and adapted to contain a malodorous and/or irritating and/or debilitating substance.

10 Claims, 1 Drawing Figure

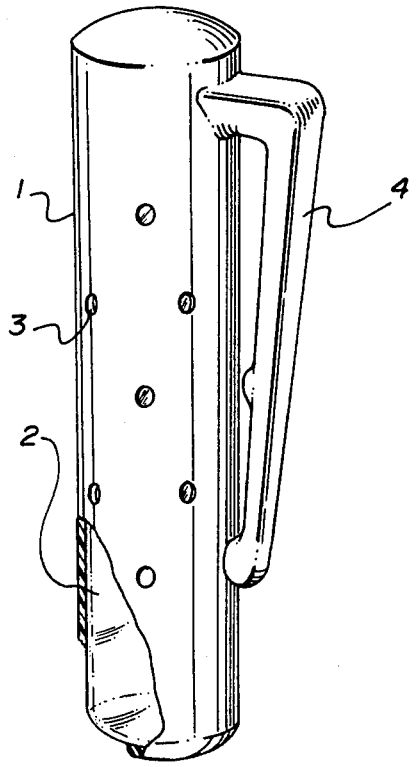
1
2
3
4

PERSONAL REPELLENT DEVICE

This is a continuation of application Ser. No. 875,190, filed Feb. 3, 1978, now abandoned.

BACKGROUND OF THE INVENTION

1. Field of the Invention

This invention relates generally to a device for repelling personal assault and in particular, for deterring would-be rapists.

2. Description of the Prior Art

The use of disabling-gas-producing chemicals in a frangible container as an anti-personnel device is well known. See, for example, U.S. Pat. No. 2,159,241, D. B. Williams, May 23, 1939. Tear gas bombs and other gas containing anti-personnel devices have been well known for many years.

It is known in such devices to utilize a malodorous component. For example, U.S. Pat. No. 1,643,954, John A. Prentice, Oct. 4, 1927, discloses the use, as a tracer component in a composition of matter adapted for either defensive or offensive projection, substances including butyl mercaptan, or other substances having a persistent, distinctive and repulsive odour.

The chemical and medical properties of amyl nitrite are well known. It is known as a short-acting vasodilator in the treatment of attacks of angina. See, for example, U.S. Pat. No. 3,106,511, Harry A. Cuttler, Oct. 8, 1963.

The use of frangible capsules for storing single-application materials is also known, for example, glass ampoules as containers for amyl nitrite, to be ruptured in the event of an attack of angina or other medical indication so as to release the contents for inhalation. It is known, for certain other purposes, to use a frangible liquid container within a flexible outer shell, also for a single use application. See for example, Canadian Pat. No. 868,455, Gilbert Schwartzman, Apr. 13, 1971, said to correspond to U.S. application Ser. No. 660,733, said to be filed Aug. 15, 1967. The Schwartzman applicator comprises a flexible outer container having a single orifice, an intermediate layer of porous material projecting from the orifice, and a frangible liquid container disposed within the layer of porous material, the frangible container being adapted to be ruptured to release into the porous material a liquid contained therein. Similarly, Canadian Pat. No. 910,563, Dyrud et al, Sept. 26, 1972, said to correspond to U.S. application Ser. No. 767,065, filed Oct. 10, 1968, now abandoned, discloses a sponge layer within which are disposed frangible liquid-containing micro-capsules.

SUMMARY OF THE INVENTION

This invention comprises a personal repellent device consisting of a capsule comprising a perforated outer shell composed of a deformable material and a rupturable sealed inner container disposed with the outer shell. The inner container contains a repellent and/or a debilitating composition which may include an irritating or debilitating substance, a malodorous repellent substance, and, if desired, a carrier material, which may have repellent qualities and/or volatile characteristics. The capsule is small in size and is adapted to be concealed on the person of a user, preferably by attachment to clothing. The outer shell is sufficiently rigid to resist substantial deformation under ordinary handling, but may be manually deformed to an extent effective to rupture the inner container and release its contents.

DESCRIPTION OF THE DRAWING

In the drawing which illustrates the preferred embodiment of the invention, the single FIGURE comprises an elevation view of the invention with a portion of the outer shell cut away to reveal the inner container.

DETAILED DESCRIPTION OF THE INVENTION

In the preferred embodiment of this invention, as depicted in the drawing, an outer shell 1 composed of a flexible plastic material has disposed within it a rupturable rigid sealed inner container 2. The outer container 1 is provided with a plurality of perforations 3. Obviously, the perforations could have shapes and configurations other than that shown in the FIGURE.

In the preferred embodiment, the outer shell 1 is provided with a clip 4 whereby the capsule is adapted to be attached to the clothing of the user. Preferably, the entire capsule is small and light for ease of attachment and concealment. In the preferred embodiment, the capsule is about 40 mm. in length, 8 mm. in diameter, and about 1.3 g. in weight. The inner container holds about ¼ ml. of n-butyl mercaptan.

The outer shell is composed of a plastic material sufficiently strong to resist substantial deformation under ordinary handling and use, but capable of being manually deformed to an extent effective to rupture the inner container. The inner container is a rigid sealed container adapted to retain its liquid contents, and is rupturable by manual pressure. A suitable substance for the inner container is glass. The inner container may comprise a glass ampoule of the type well known in the medical arts. The outer container may suitably be composed of polypropylene plastic or other suitable plastics. The thickness and dimension of the outer shell and inner container should be selected so that the inner container will be ruptured when about 20 lbs. of pressure is applied to the outer shell, manually or otherwise. This order of pressure has been found to be sufficiently high that the capsule will not rupture accidentally under normal handling in packaging, distribution, or sale, or by the user, but is rupturable manually by users of normal physical strength.

The contents of the inner container are selected so as to repel a would-be assaulter or rapist. In the preferred embodiment, the only material contained in the inner container is n-butyl mercaptan, a material well known for its pungent and offensive odour. The release of this material alone is adapted to repel assault, and also to mark the would-be assaulter to facilitate identification and capture. Of course, the malodorous substance also attaches itself to the victim, and for this purpose, a deodorizing composition may be supplied with the repellant capsule. A suitable deodorizer is "Nil-Odor" TM, which may be contained in a small vial that may be sold together with the capsule as part of a kit.

The capsule may also contain an inert carrier material, which may be a volatile substance, or may otherwise have a propellant capacity. In addition, the inner container may contain an irritating or debilitating substance. One useful additional component is amyl nitrite, which is useful as a volatile medium, useful for its unpleasant odour, and also useful for its medical activity as a vasodilator. The medical properties of amyl nitrite may be particularly useful in the case of attempted rape.

One effect of inhalation by the rapist of amyl nitrite may be to induce premature ejaculation, thereby depriving the attacher of the ability to commit the crime. This effect, particularly when combined with the repellent effect of the n-butyl mercaptan, provides a strong inducement against continuation of the assault in any manner whatsoever.

While this invention has been described in terms of a capsule with a clip for attachment to clothing, it could of course take many other forms. It could, for example, be attached to, or part of, a brooch or pendant. In addition, many possible variations in the contents may be adopted, depending on the particular application for which the capsule is to be used, and the particular properties required.

What I claim as my invention is:

1. A personal assault deterrent device comprising:

a capsule formed of a single thickness of plastic material, said capsule having a free and uncovered outer surface and an inner surface;

a rupturable sealed glass ampoule positioned within said capsule, said ampoule containing therein a volatile composition of a nature adapted to deter and repel a potential assailant, said ampoule having an outer surface in contact with said inner surface of said capsule;

said capsule having perforations extending entirely through said single thickness of plastic material, from said free and uncovered outer surface thereof to said inner surface thereof; and said capsule being sufficiently rigid to resist substantial deformation during normal handling, but said capsule being sufficiently deformable such that forceful manual pressure applied to said capsule will cause deformation thereof and will cause said ampoule to rupture, whereby said volatile composition will be dispersed through said perforations.

2. A device as claimed in claim 1, wherein said volatile composition includes at least one component selected from the group consisting of the mercaptans.

3. A device as claimed in claim 1, wherein said volatile composition comprises n-butyl mercaptan.

4. A device as claimed in claim 1, wherein said volatile composition is selected from the group consisting of malodorous substances and debilitating substances.

5. A device as claimed in claim 1, further comprising at least one inert carrier within said ampoule.

6. A device as claimed in claim 1, further comprising at least one volatile propellant within said ampoule.

7. A device as claimed in claim 1, wherein said volatile composition is a mixture of amyl and n-butyl mercaptan.

8. A device as claimed in claim 1, wherein said plastic material comprises polypropylene.

9. A device as claimed in claim 1, further comprising clipping means on said capsule for attaching said capsule to the clothing of a user of said device.

10. A device as claimed in claim 1, wherein said outer surface of said ampoule is in contact throughout the entire peripheral extent thereof with said inner surface of said capsule.

* * * * *